US005587542A

United States Patent [19]

Everly

[11] Patent Number: 5,587,542

[45] Date of Patent: Dec. 24, 1996

[54] TUNABLE PLECTRUM

[76] Inventor: Philip Everly, 10414 Camarillo St., North Hollywood, Calif. 91602

[21] Appl. No.: 638,801

[22] Filed: Apr. 29, 1996

[51] Int. Cl.[6] ..... G10D 3/16

[52] U.S. Cl. ..... 84/322

[58] Field of Search ..... 84/320, 322

[56] References Cited

U.S. PATENT DOCUMENTS

| | | | |
|---|---|---|---|
| 1,461,070 | 7/1923 | Budesyle | 84/322 |
| 3,319,505 | 5/1967 | Galetzky | 84/322 |
| 3,699,838 | 10/1972 | Montgomery | 84/322 |

*Primary Examiner*—Patrick J. Stanzione
*Attorney, Agent, or Firm*—Julius L. Rubinstein

[57] ABSTRACT

A tunable plectrum or pick for guitars and the like, is formed from a suitable material with planar opposed surfaces, an opening extends through the opposed surfaces whereby the skin of the thumb and index fingers of the musician can engage each other to stabilize the pick on the fingers of the musician. The periphery of the opening defines a plurality of angularly spaced inwardly projecting finger engaging material points. The points are sharp enough to pierce the skin of the musician with enough force to further stabilize the pick on the finger. In addition, the periphery of the opening, also defines outwardly projecting tuning openings whose number and shape affects the tune of the pick. Means are provided to modify the shape of the inwardly projecting finger engaging material points, the outwardly projecting tuning openings, and the size of the opening extending through the planar surfaces to tune the pick.

4 Claims, 1 Drawing Sheet

TUNABLE PLECTRUM

This invention relates to a plectrum, and more particularly to a plectrum which can be tuned to the requirements of a musician using a stringed instrument.

FEDERALLY SPONSORED RESEARCH

No part of this patent application was developed with the aid of any federally sponsored research and development.

BACKGROUND AND PRIOR ART

A plectrum, commonly referred to as a pick, is a small, piece of material such as metal, ivory, tortoise shell, celluloid etc. having opposed, usually planar, surfaces. The pick is used for plucking the strings of a stringed instrument. These plectrums or picks are never noticed by people listening to the instrument being played, but they are important to the players of the instrument. In a sense musicians are married to their picks. The reason is that subtle variations in the shape of the pick, the material its made of, its resilience, and its size, affect the tone of the musical instrument in the hands of the musician. Since all musicians have different requirements, once a musician finds his "perfect pick" he guards it very carefully.

The pursuit of the perfect pick by players of stringed instruments, has resulted in the development of picks available in a fantastic variety of sizes, shapes, and materials as described and shown in the definitive work "Picks" by Will Hoover, published by Miller Freeman Books, of 600 Harrison St. San Francisco, 94107, @1995 along with the citations set forth therein.

Other patented picks are shown in the patents to Kline U.S. Pat. No. 5,253,562, Gonzales, U.S. Pat. No. 4,137,814, Moshay U.S. Pat. No. 3,113,668, Paxtom, U.S. Pat. No. 3,595,118, Galetzky, U.S. Pat. No. 3,319,505, Adamec U.S. Pat. No. 4,270,433, Chemette, U.S. Pat. No. 3,648,558, McPherson, Sr. U.S. Pat. No. Des. 268,844, and the German patent to Adamec #29 11 619.

The pick is grasped between the thumb and index finger of the player of a stringed instrument, such as a guitar, mandolin, etc. as shown in the German patent to Adamec #29 11 619 and FIG. 3 of the Moshay patent. In use, the strings of the instrument are strummed or plucked. But one of the problems with prior picks was its tendency to slip or rotate between the grasping thumb and index finger when the pick was forcibly used on the strings of the instrument (depending on the requirements of the music). An initial attempt to solve these problems was considered in the Moshay U.S. Pat. No. 3,113,668. Moshay formed a circular hole in the pick. This permitted the skin of the thumb and index finger to engage each other on opposite surfaces of the pick. In this way, when the pick was in use, the stability of the pick in the fingers of the musician was increased. However, this arrangement was not completely suitable because the smooth periphery of the opening in the Moshay pick did not provide sufficient resistance to pick movement or rotation when the musician was required to play his instrument intensively.

But resistance to rotation or other movement is only one factor in the selection of a perfect pick for each musician. Other factors are the tone and feel of the pick. Up to now, no attempt was made to design a pick with these requirements in mind. Instead, musicians had to engage in a tedious trial and error method by practicing with a large variety of picks to find the one most suitable. It is clear that by initially selecting a pick from a preferred material and thickness, the search for a pick with the desired shape, flexibility, and tone, could be shortened.

But another problem has to be considered. After a "perfect pick" has been found, in the course of time, it could become lost, or it could wear down and have to be replaced. Finding an identical replacement for the perfect pick from among all the multitude of picks available, is difficult and time consuming because it is not economical for music stores to keep in stock the enormous numbers of picks that are available, (see "Picks" by Will Hoover) cited above. This suggests a need for a standard tunable pick, because such a pick could be economically stocked in music stores. In this way, a musician who had previously tuned a standard tunable pick, could easily select another, and tune it, so it is exactly like his prior pick in tone and feel.

What is needed therefore and comprises an important object of this invention is to provide a standard tunable pick which can be easily modified to change its tone and feel.

These and other objects of this invention will become more apparent when better understood in the light of the specification and drawings wherein.

Figure 1:
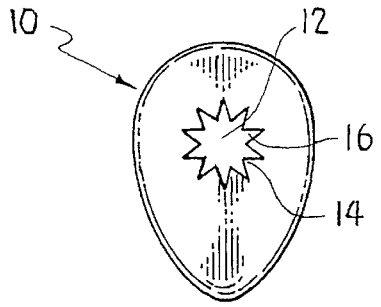
FIG. 1 is a plan view of a standard tunable pick constructed according to the principles of this invention.
Figure 2:
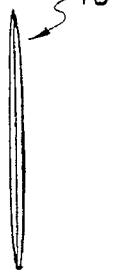
FIG. 2 is a side view of the pick shown in FIG. 1.
Figure 7:
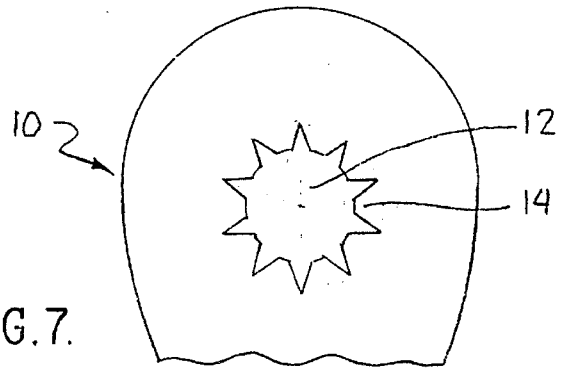

FIG. 7. is a plan view of the pick shown in FIG. 1 after the shape of the opening has been modified by eliminating all of the inwardly projecting points.

Referring now to FIG. 1 of the drawing there is shown a standard tunable pick 10 made from a suitable material with the peripheral shape and thickness, determined by the experience of the musician. The pick has an opening 12 extending therethrough. The periphery of this opening includes a plurality of angularly spaced inwardly projecting finger engaging material points 14 and outwardly projecting pointed tuning openings 16 formed in the pick. When the thumb and index finger of the musician hold the pick, the points 14 dig into the abutting surfaces of the skin and offer greater resistance to movement of the pick, when in use. The shape of the opening 12 and the inwardly projecting material points 14 and the outwardly projecting pointed tuning openings 16 are adapted to be modified in order to tune the pick, as described below.

The pick, as shown in FIG. 1, has a certain flexibility and feel and produces a particular tone. As stated above, the tone and flexibility of the pick can be varied by changing the shape, size, and number of the inwardly projecting points and the shape, size, and number of said outwardly projecting pointed openings by using any suitable means, break lines for example, although other means are contemplated. These changes affect the tone of the pick. In addition, the increased area of the finger engaging portion of the opening 12 in the pick, affects the stability of the pick on the fingers of the musician.

Figure 6:
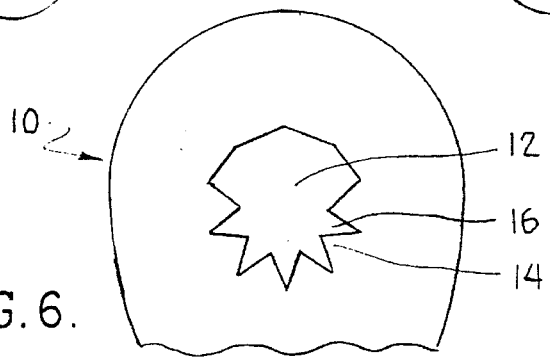
FIG. 6 is a plan view of a pick similar to the pick shown in FIG. 1 but after the shape of the opening in the pick has been altered and enlarged by eliminating or decreasing the size of all or some of the inwardly projecting material points.

The pick shown in FIG. 6, has had several of the inwardly projecting points 14 eliminated by any suitable means. but the area of the skin of the abutting finger on opposite sides of the pick has been increased and the flexibility of the pick has been changed, thereby affecting the stability of the pick on the fingers of the musician. In addition the change in the number and size of the pointed openings 16 will affect the tone of the pick.

Figure 3:
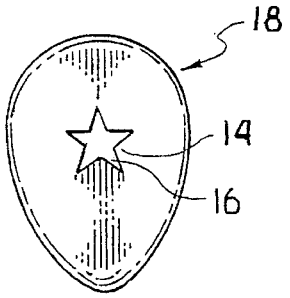
FIG. 3 is a plan view of another embodiment of the pick shown in FIG. 1. The side view of the pick shown in FIG. 3 is the same as the view shown in FIG. 2.

The pick 10 shown in FIG. 1 has ten inwardly projecting material points 14, while the modified pick 18 shown in FIG. 3 has five. Both picks can be tuned the same way, but the greater the number of inwardly projecting material points, the more precisely the pick can be tuned.

Figure 4:
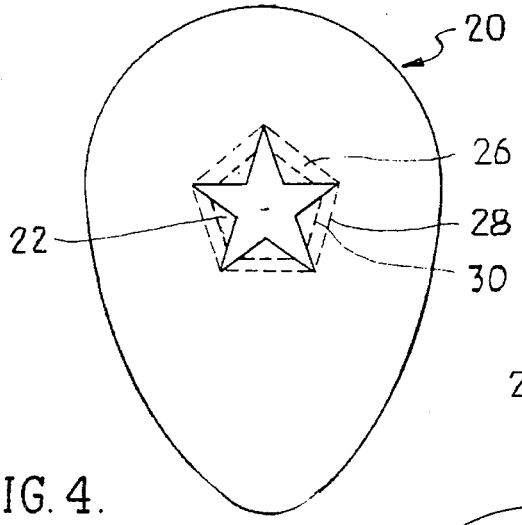
FIG. 4 is a plan view of another embodiment of the pick shown in FIGS. 1 and 3 in which break lines are formed in the inwardly projecting material points so that by breaking away selected ones, the shape of the outwardly projecting openings can be changed.
Figure 5:
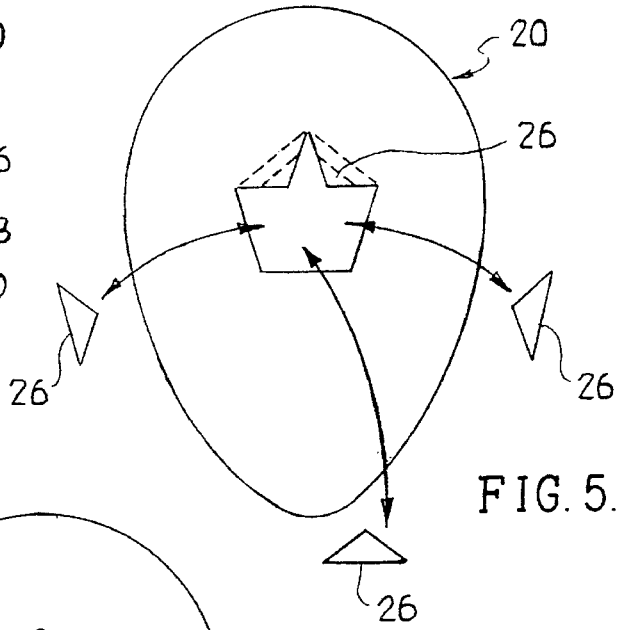
FIG. 5 is a plan view of the pick shown in FIG. 4, but with parts broken away to vary the shape of the opening in the pick.

The pick 20 shown in the embodiment in FIG. 4 has both inwardly projecting material points 22 and outwardly projecting openings 24 defining, in this particular embodiment, five triangular portions 26. Break lines 28 and 30 are formed in the pick so that selected portions or parts of portions 26 can be broken away from the pick, as desired, see FIG. 5. For purposes of illustration, the embodiment of FIG. 5, discloses three triangular portions 26 which have been broken or partially broken away from the break lines in the pick, to tune the pick 20 more precisely. Other means for doing the same things are contemplated. Picks like the one shown in FIG. 4 can have any number of breakaway portions, in accordance with the requirements of the musician.

The embodiment shown in FIG. 6 is like the pick shown in FIG. 1, but with four of the inwardly projecting points 14 removed by any suitable means to increase the size of the finger engaging opening to optimize (from the point of view of the musician) the stability and tune of the pick.

The embodiment shown in FIG. 7 discloses a pick like the one shown in FIG. 1 but with all the inwardly projecting points removed to tune the pick in accordance with the desire of the musician.

Having described the invention, what I claim as new is:

1. A tunable plectrum comprising a planar material having opposed surfaces, said opposed surfaces having an opening extending therethrough, said opening having a center, the periphery of said opening including a plurality of angularly spaced inwardly projecting finger engaging material points extending into said opening toward said center, the periphery of said opening between said material points forming pointed outwardly extending tuning openings pointing radially away from said center, and means for varying the size, shape, and number of said inwardly projecting material points and the size, shape and number of said outwardly pointing tuning openings both to increase the size of said opening to enable the musician to hold the plectrum with stability and to tune the plectrum.

2. The plectrum described in claim 1 wherein the finger engaging material points are sharp enough to penetrate the skin of the thumb and index finger of the musician with enough force to stabilize the pick on the fingers of the musician.

3. A tunable plectrum comprising a planar material having opposed surfaces, said opposed surfaces having an opening extending therethrough, the periphery of said opening including a plurality of equally angularly spaced inwardly projecting finger engaging material points extending into said opening toward said center, the periphery of said opening between said material points forming pointed outwardly extending tuning openings pointing radially away from said center, and means for varying the shape of the opening extending through said opposed surface including the size and number of said inwardly projecting material points and the size and shape of the outwardly POINTING tuning openings to tune the plectrum and CONTROL its stability on the fingers of the musician.

4. A tunable plectrum comprising a planar material having opposed surfaces, said opposed surfaces having an opening extending therethrough, said opening having a center, the periphery of said opening including a plurality of angularly spaced radially inwardly projecting finger engaging material points extending into said opening toward said center. The periphery of said opening between said material points forming pointed outwardly extending tuning openings pointing radially away from said center, said radially inwardly projecting pointed finger engaging material points having one or more break lines formed therein, so that by breaking any portion of the break lines, the size of said opening extending through said opposed surfaces, the size and number of said radially inwardly projecting material points, and the size and number of said outwardly projecting tuning openings can be varied to tune the plectrum.

* * * * *